US007052440B2

(12) United States Patent
Pyles et al.

(10) Patent No.: US 7,052,440 B2
(45) Date of Patent: May 30, 2006

(54) DUAL-FUNCTION TREADING EXERCISER

(75) Inventors: Nathan Pyles, Lake Mills, WI (US); Derek Nelson, Lake Mills, WI (US); Chih-Jen Wang, Taichung (TW); Hung-Mao Liao, Taichung (TW)

(73) Assignee: Johnson Health Tech Co., Ltd., Taichung Hsien (TW)

( * ) Notice: Subject to any disclaimer, the term of this patent is extended or adjusted under 35 U.S.C. 154(b) by 75 days.

(21) Appl. No.: 10/603,117

(22) Filed: Jun. 24, 2003

(65) Prior Publication Data

Related U.S. Application Data

(63) Continuation-in-part of application No. 10/303,724, filed on Nov. 26, 2002, now abandoned.

(51) Int. Cl.
*A63B 22/02* (2006.01)

(52) U.S. Cl. ..... 482/54; 482/120; 482/121

(58) Field of Classification Search ..... 482/51–74, 482/114–116, 118–122, 126, 127
See application file for complete search history.

(56) References Cited

U.S. PATENT DOCUMENTS

| | | | | | |
|---|---|---|---|---|---|
| 4,089,520 | A | | 5/1978 | Ozbey et al. | |
| 4,625,962 | A | * | 12/1986 | Street | 482/116 |
| 4,659,077 | A | * | 4/1987 | Stropkay | 482/70 |
| 4,709,918 | A | * | 12/1987 | Grinblat | 482/70 |
| 5,000,440 | A | | 3/1991 | Lynch | |
| 5,013,035 | A | | 5/1991 | Nathaniel | |
| 5,104,119 | A | | 4/1992 | Lynch | |
| 5,110,117 | A | | 5/1992 | Fisher et al. | |
| 5,254,064 | A | | 10/1993 | Rock | |
| 5,429,563 | A | | 7/1995 | Engel et al. | |
| 5,476,431 | A | | 12/1995 | Wilkinson et al. | |
| 5,509,873 | A | | 4/1996 | Corn | |
| 5,533,952 | A | * | 7/1996 | Schaber | 482/70 |
| 5,733,231 | A | | 3/1998 | Corn et al. | |
| D399,272 | S | | 10/1998 | Zwonitzer | |
| 5,916,069 | A | * | 6/1999 | Wang et al. | 482/72 |
| 5,951,449 | A | | 9/1999 | Oppriecht | |
| 6,042,516 | A | * | 3/2000 | Norton | 482/54 |
| 6,077,199 | A | | 6/2000 | Hsu | |
| 6,123,649 | A | * | 9/2000 | Lee et al. | 482/54 |
| 6,328,677 | B1 | * | 12/2001 | Drapeau | 482/72 |
| 6,599,223 | B1 | * | 7/2003 | Wang et al. | 482/138 |
| 6,811,520 | B1 | * | 11/2004 | Wu et al. | 482/92 |

* cited by examiner

*Primary Examiner*—Stephen K. Cronin
*Assistant Examiner*—Tam Nguyen
(74) *Attorney, Agent, or Firm*—Patricia Smith King

(57) ABSTRACT

A dual-function exercise device includes lower body exercise device, a frame, and a movable handle assembly. The movable handle assembly includes two independent pulling devices and a rotary shaft journalled on the frame. Each pulling device includes a pulley disposed rotatably on the frame, a pull cord wound on the pulley, a handgrip fastened to an end of the cord and movable to unwind the cord from the pulley, and a biasing unit for biasing the cord to wind around the pulley when the cord is pulled and is subsequently released.

31 Claims, 14 Drawing Sheets

DUAL-FUNCTION TREADING EXERCISER

CROSS-REFERENCES

The present application is a continuation-in-part of, and claims the benefit of priority to, U.S. application Ser. No. 10/303,724, filed 2002 Nov. 26, now abandoned entitled "Dual-function treading exerciser," which claims the benefit of priority to application Ser. No. 091,207,866, filed 2002 May 29 in Taiwan (R.O.C.), entitled "Dual-function treading exerciser," currently pending.

FIELD AND BACKGROUND OF THE INVENTION

The invention relates to a dual-function exerciser that exercises muscles and muscle groups in both the upper and lower body.

A conventional treading exerciser includes a treading platform, a continuous tread that extends around the platform, an upright frame that extends upwardly from a front end of the platform, a control panel mounted on a top portion of the upright frame, and a pair of fixed handles disposed on opposite sides of the control panel.

Some treading exercises include upper body exercise components that attempt to simulate various activities such as running, cross-country skiing, and others. These prior devices have numerous disadvantages that fail to exercise the muscle groups of the chest and abdomen or do so in an unnatural movement. Other devices are impractical to manufacture or difficult to maintain.

SUMMARY OF THE INVENTION

Therefore, the main object of the present invention is to provide a dual-function exerciser that can provide exercise function for the whole body of the user, that can train the user's arm, chest, back, abdominal, and leg muscles, and that can improve functioning of the user's cardiopulmonary system. The exerciser includes independently operated movable handle units that provide a variety of arm movements to simulate different activities.

According to the present invention, a dual-function exerciser can include a treading platform, an upright frame, and a movable handle assembly. The treading platform has a front end, and is provided with a continuous tread extending around the platform. The upright frame includes an upright frame body connected to the front end of the platform, and an optional pair of fixed handles connected to an upper portion of the frame body. The movable handle assembly includes a pair of pulling devices mounted on the frame, and a rotary shaft journalled on the frame. Each of the pulling devices includes a housing with a receiving chamber, a pulley disposed rotatably in the chamber, a pull cord wound on the pulley, a handgrip fastened to an end of the pull cord and movable rearwardly to unwind the pull cord from the pulley, and a biasing unit for biasing the pull cord to wind around the pulley when the cord is pulled rearwardly and is subsequently released. This device permits the user's arms to move independently from one another and in a more natural motion.

Instead of a tread exerciser, other embodiments can include elliptical motion devices, stair climbers, bicycles and others.

BRIEF DESCRIPTION OF THE DRAWINGS

Other features and advantages of the present invention will become apparent in the following detailed description of the preferred embodiments with reference to the accompanying drawings, of which.

DESCRIPTION OF THE PREFERRED EMBODIMENTS

Figure 1:
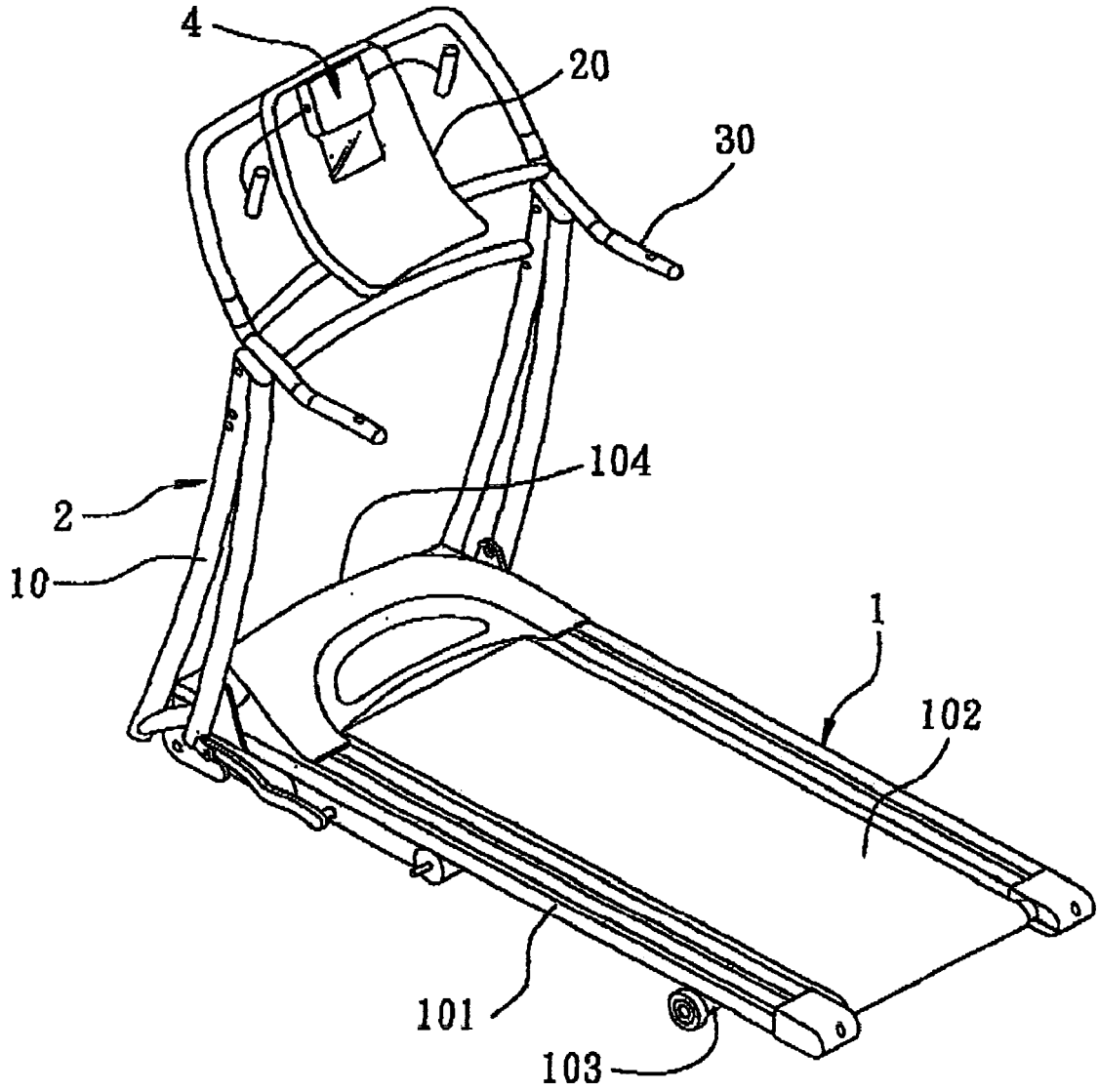
FIG. 1 is a perspective view of the first preferred embodiment of a dual-function treading exerciser according to the present invention.

Before the present invention is described in greater detail, it should be noted that like elements are denoted by the same reference numerals throughout the disclosure.

Referring to FIG. 1, the first preferred embodiment of a dual-function exerciser according to the present invention. The dual-function exerciser in the depicted embodiments includes a treadmill for exercising the lower body, but it could be another type of exerciser such as an elliptical motion machine, a stair step device, or a bicycle, for example. The treadmill portion of the depicted exerciser is shown to comprise a treading platform 1, an upright frame 2, and a movable handle assembly 4.

The treading platform 1 includes a base 101, a continuous tread 102 exposed from a top portion of the base 101 and disposed to extend around the platform 1, a foot member 103 disposed on a bottom portion of the base 101 for supporting the platform 1, and a front end 104. The foot member 103 either alone or in combination with other foot members can be designed to adjust the incline angle of the tread.

The upright frame 2 includes an upright frame body 10 connected to the front end 104 of the platform 1, a control panel 20 mounted on the upright frame body 10 in a known manner, and a pair of fixed handles 30 connected to an upper portion of the frame body 10. The connections may be bolted, welded or joined in any suitable manner. Further, the fixed handles 30 are optional and provide the user of using only the tread portion, if desired.

Figure 2:
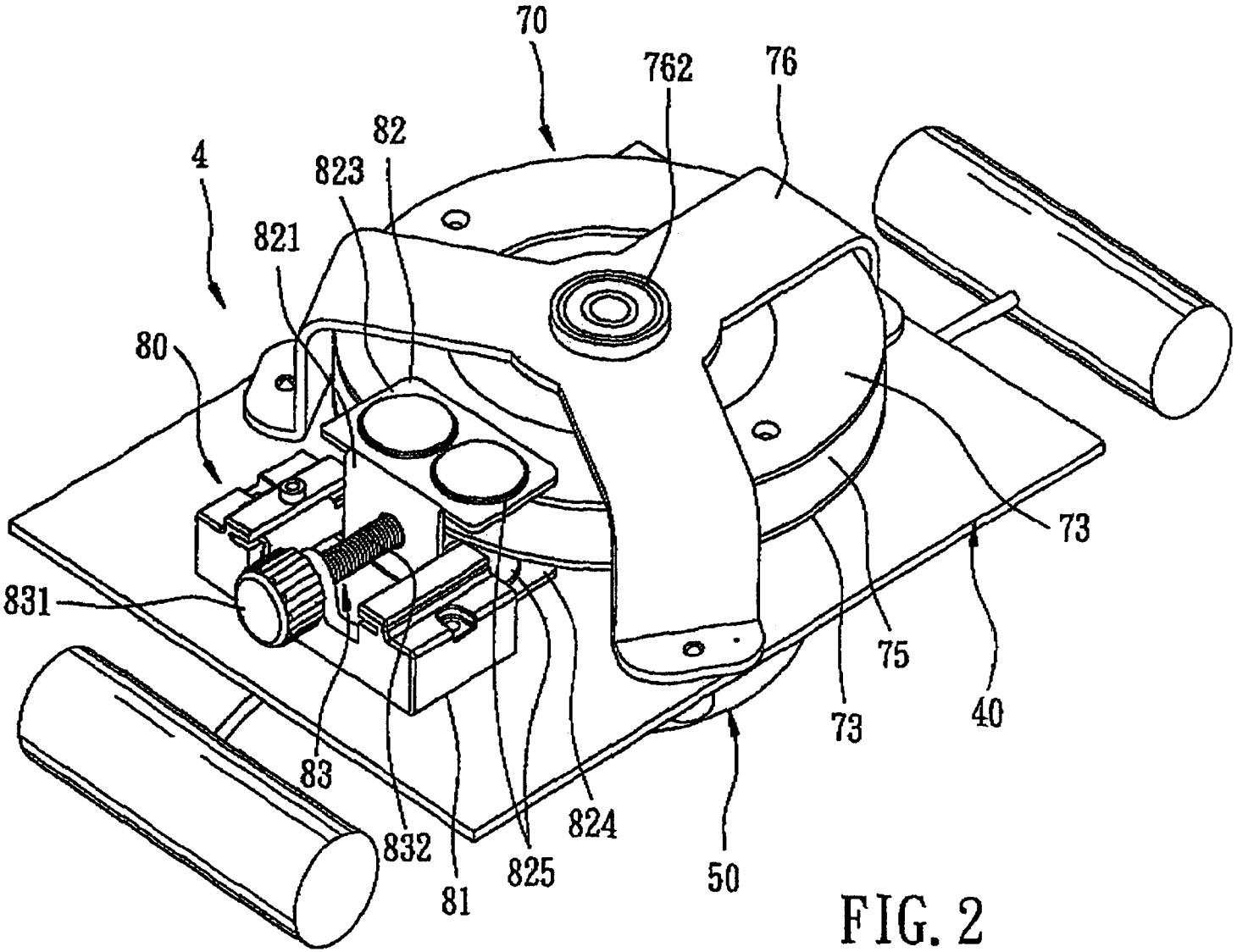
FIG. 2 is a perspective view of a movable handle assembly of the first preferred embodiment.
Figure 3:
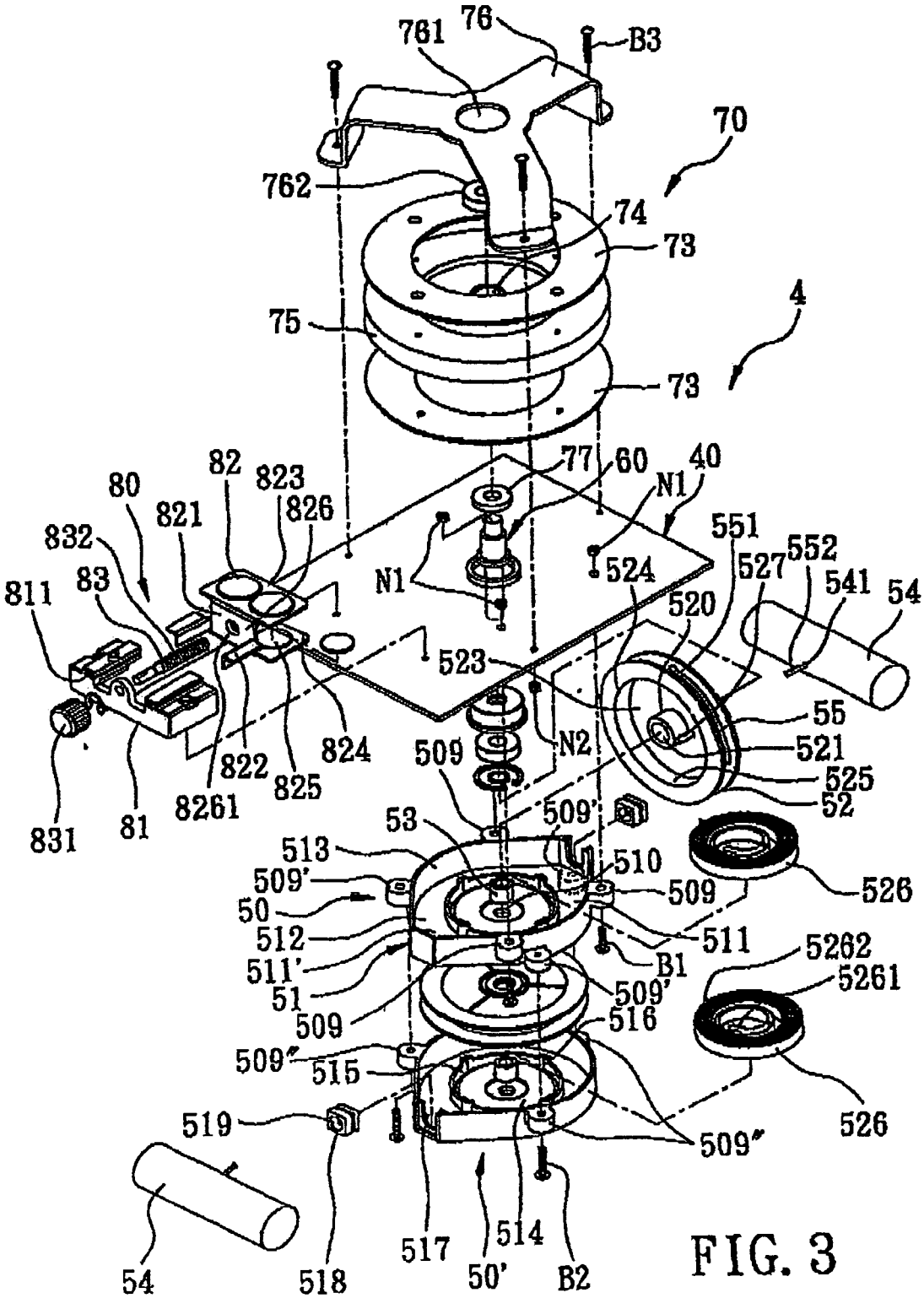
FIG. 3 is a partly exploded perspective view of the movable handle assembly of the first preferred embodiment.
Figure 8:
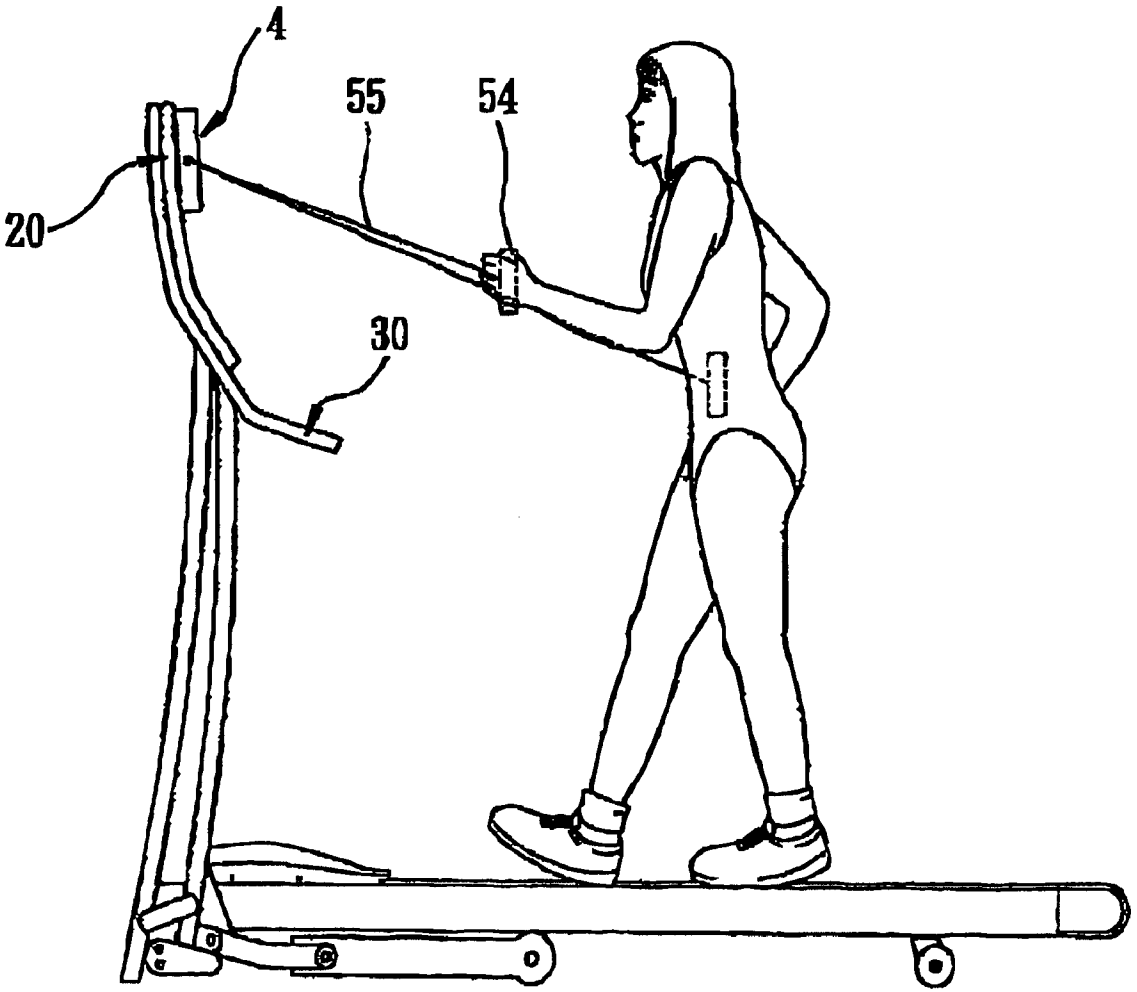
FIG. 8 is a schematic view of the first preferred embodiment in a state of use.

The movable handle assembly 4 is mounted on the control panel 20 of the frame 2 (see FIG. 1), and is preferably disposed substantially higher than the fixed handles 30 (see FIG. 1) in this embodiment. Referring to FIGS. 2, 3, and 8, the movable handle assembly 4 is shown to include a support plate 40, a pair of superimposed upper and lower pulling devices 50, 50' mounted on a rear side surface of the plate 40, a flywheel assembly 70 mounted on a front side of the plate 40, a rotary shaft 60 journalled on the plate 40, and an adjustable magnetic resistance device 80 mounted on the plate 40 and disposed adjacent to the flywheel assembly 70.

Each of the upper and lower pulling devices 50, 50' includes a housing 51 with a receiving chamber 511, a pulley 52 disposed rotatably in the chamber 511, a unidirectional bearing 53, a pull cord 55 wound on the pulley 52, a handgrip 54, and a biasing unit. Since the pulling devices 50 are generally similar to each other in construction, only one of the pulling devices 50 will be described in the succeeding paragraph. Although described and depicted as vertically superimposed, the pulling devices 50 and 50' can be horizontally superimposed, at different orientations, or spaced apart, and be within the scope of the present invention.

The housing 51 includes a bottom wall 511', an outer surrounding wall 513 that extends frontwardly from an outer periphery of the bottom wall 511', a central hole 510 for extension of the rotary shaft 60 there through, and an inner surrounding wall 515 that is disposed between the central hole 510 and the outer surrounding wall 513. A pulley-receiving chamber 512 is defined among the bottom wall 511', the outer surrounding wall 513, and the inner surrounding wall 515.

A receiving space 514 is defined among the bottom wall 511', the inner surrounding wall 513, and the unidirectional bearing 53. The pulley-receiving chamber 512 and the receiving space 514 constitute the receiving chamber 511. The outer surrounding wall 513 is formed with a notch 517, and has a positioning piece 518 that is inserted removably into the notch 517 and that has a cord hold 519. The inner surrounding wall 515 is formed with a retaining groove 516.

The pulley 52 is disposed in the pulley-receiving chamber 512 in the housing 51, is formed with a reeling portion 522, an axial hole 521 defined by an annular inner wall 520 for receiving the unidirectional bearing 53 therein, and a receiving space 524 that is defined cooperatively by a bottom wall 523 and an annular outer wall 525 of the pulley 52 and that cooperates with the receiving space 514 in the housing 51 to confine the biasing unit between the housing 51 and the pulley 52.

The pull cord 55 is wound on the pulley 52, and has a front-end portion 551 fastened to the reeling portion 522 of the pulley 52, and a rear end portion 552 that extends out of the housing 51 and that is fastened to the handgrip 54. The pull cord 55 can be made of any material that can apply tension to rotate the pulley 52 and then be retracted for subsequent and repetitious operation. As used herein, "cord" can include any material that can be tensioned such as rope, chain, leather, rubber, natural or manmade materials. The unidirectional bearing 53 is disposed between the rotary shaft 60 and the pulley 52 so as to rotate the rotary shaft 60 synchronously with the pulley 52 only when the pulley 52 rotates in a direction, in which the pull cord 55 is unwound from the pulley 52.

Although depicted as being positioned on the control panel 20, the movable handle assembly can be connected to any portion of the device with the cords 55 extending over pulleys or through guides that create an effect of tension at or above shoulder level of the user.

Figure 6:
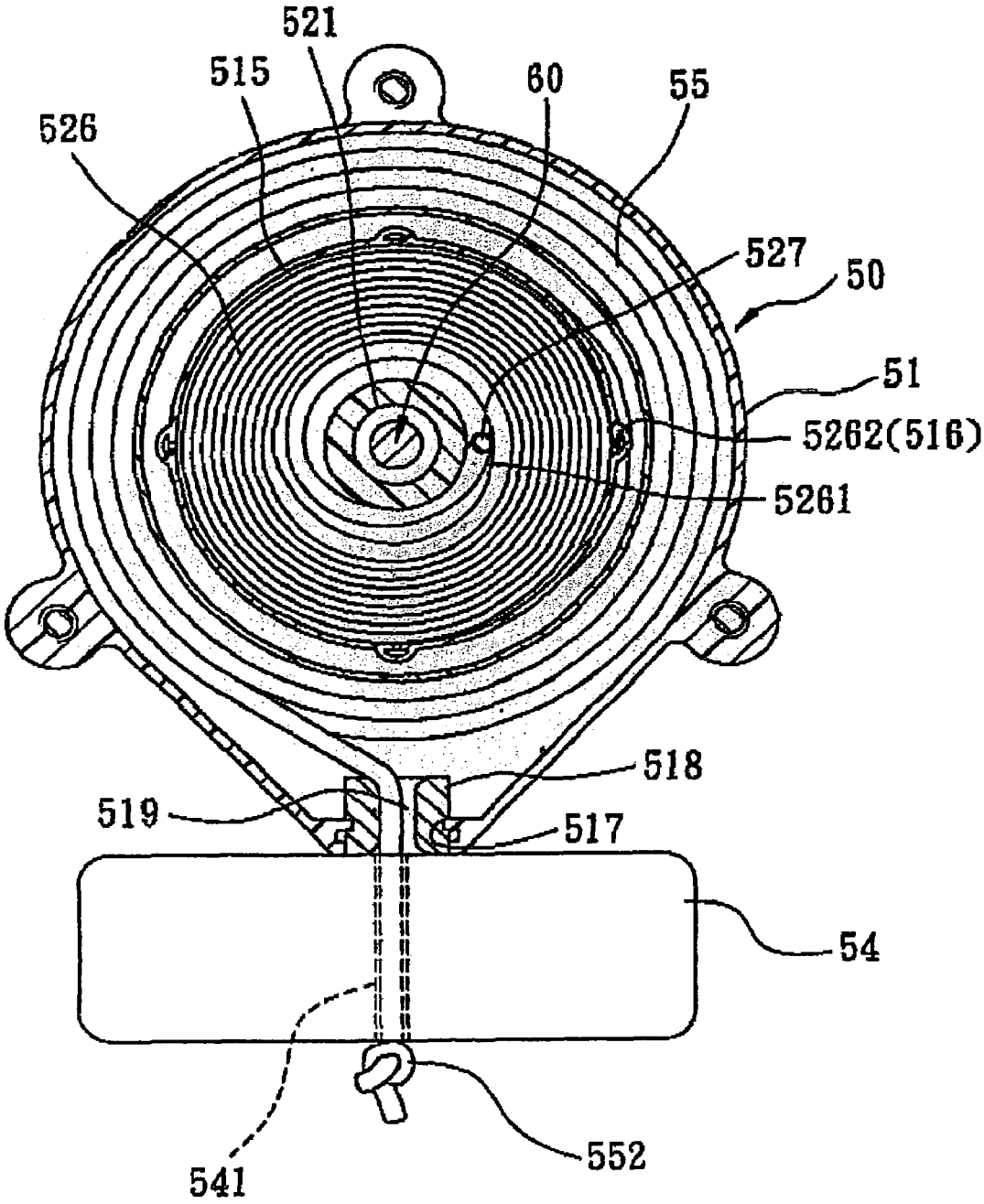
FIG. 6 is a sectional schematic view of a lower pulling device of the movable handle assembly of the first preferred embodiment, illustrating a pull cord, a biasing unit, and a handgrip of the pulling device in a normal state.
Figure 7:
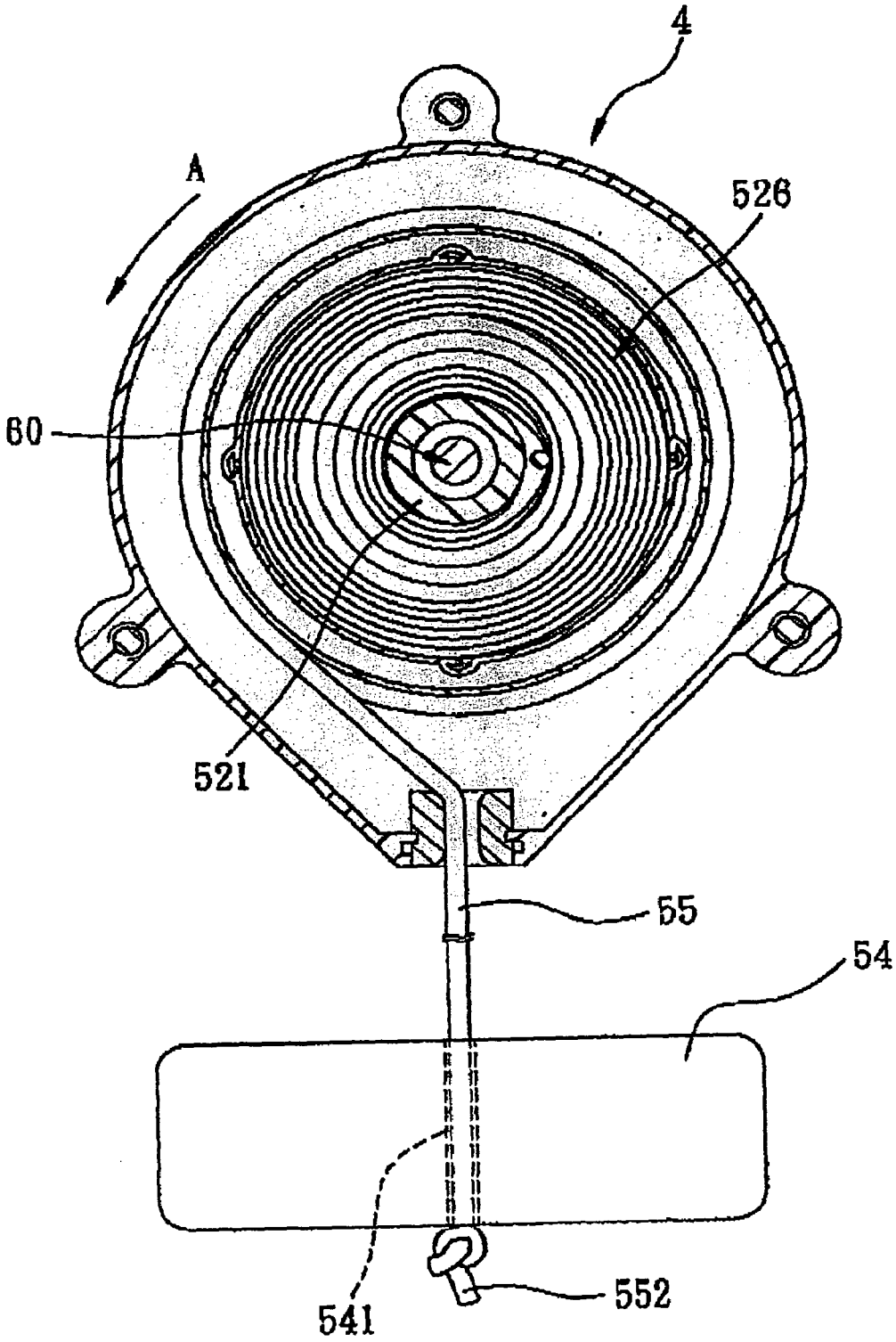
FIG. 7 is a view substantially similar to FIG. 6, illustrating the lower pulling device of the movable handle assembly of the first preferred embodiment in a state of use.

The handgrip 54 is movable rearwardly to unwind the pull cord 55 from the pulley 52. The handgrip 54 is disposed outside the housing 51, is formed with a through hole 541 for extension of the rear end portion 552 of the pull cord 55 there through, and is retained on the pull cord 55 by tying the rear end portion 552 of the pull cord 55 into a knot, as shown in FIGS. 6 and 7. The biasing unit is used for biasing the pull cord 55 to wind around the pulley 52 when the pull cord 55 is pulled rearwardly and is subsequently released, and includes a spring member 526 connected between the housing 51 and the pulley 52 for biasing the pulley 52 to rotate in the chamber 512 in a predetermined direction. In this embodiment, the spring member 526 is a spiral spring that has one end 5262 inserted into the retaining groove 516 in the inner surrounding wall 515 of the housing 51, and the other end 5261 fastened to a post 527 on the bottom wall 523 of the pulley 52. To vary the force exerted by the spring member 526, the spring can be repositioned, tightened or loosened by an external handle or other suitable mechanism.

The only difference between the upper and lower pulling devices 50, 50' resides in that the housing 51 of the upper pulling device 50 is formed with three upper lugs 509 fixed to the support plate 40 by means of three bolts (B1) (only one is shown in FIG. 3) that extend through the upper lugs 509; while the housing 51 of the lower pulling device 50' and the plate 40 to engage three nuts (N1), and three lower lugs 509'A is formed with three lugs 509"B fixed threadedly to the lower lugs 509' by means of three bolts (B2).

The flywheel assembly 70 is mounted on the rotary shaft 60, and includes a flywheel 75 having a central hole 74, a pair of magnetically conductive brass rings 73 disposed respectively on opposite sides of the flywheel 75, and a protective member 76 that is mounted on the support plate 40 by means of three screws (B3) that extend through the protective member 76 and the plate 40 to engage three nuts (N2) (only one is shown in FIG. 3). The rotary shaft 60 extends through the central hole 74 in the flywheel 75 in such a manner that the flywheel 75 is sleeved on the rotary shaft 60. The protective member 76 has a central hole 761 with a bearing 762 inserted therein. The rotary shaft 60 is journalled on the support plate 40 by means of a thrust bearing 77 and the bearing 762 so as to permit smooth rotation of the flywheel 75 relative to the plate 40.

The adjustable magnetic resistance device 80 is disposed adjacent to the flywheel assembly 70 so as to provide resistance to rotation of the flywheel assembly 70, and includes a positioning seat 81, a threaded shaft 83, and a magnet seat 82. The positioning seat 81 is fixed on the support plate 40, and has two spaced-apart parallel sliding rails 811. The threaded shaft 83 is journalled on the positioning seat 81, and has one end provided with a hand knob 831 to facilitate manual adjustment of the threaded shaft 83, and the other end formed with an externally threaded portion 832. The magnet seat 82 includes a U-shaped body 821 and two spaced-apart parallel sliding plates 822 that are connected to the U-shaped body 821 and that are disposed respectively and slidably along the sliding rails 811. The body 821 has two opposite side walls 823, 824 which are provided respectively with two aligned magnet units 825, between which the flywheel assembly 70 is disposed, and a connecting wall 826 which interconnects the side walls 823, 824 and which is formed with a threaded hole 8261 that engages the externally threaded portion 832 of the threaded shaft 83 so as to move the U-shaped body 821 toward and away from the flywheel 75 when the threaded shaft 83 is rotated relative to the positioning seat 81, thereby adjusting magnitude of the resistance.

Referring to FIG. 8, when performing a running exercise, the user's hands can grip the fixed handles 30 so as to obtain suitable body support, thereby preventing accidents due to imbalance. When the user performs a treading exercise or jogging, the user's hands can pull the handgrips 54 and move the foot and body portions accordingly. Due to the resistance provided by the spring members 526 (see FIG. 5) of the biasing units when the handgrips 54 are pulled from the position shown in FIG. 6 to the position shown in FIG. 7, training of the user's forearms, stomach and leg muscles can be achieved, and functioning of the user's lungs can be improved, thereby effecting whole body exercise. Thus, the dual-function treading exerciser of the present invention does not only function as an ordinary treading exerciser, but also can provide training of the user's arm portion, back, chest and abdominal portion and leg portion and improve functioning of the cardiopulmonary system while permitting movement of the user's body in a comfortable and natural manner.

Figure 4:
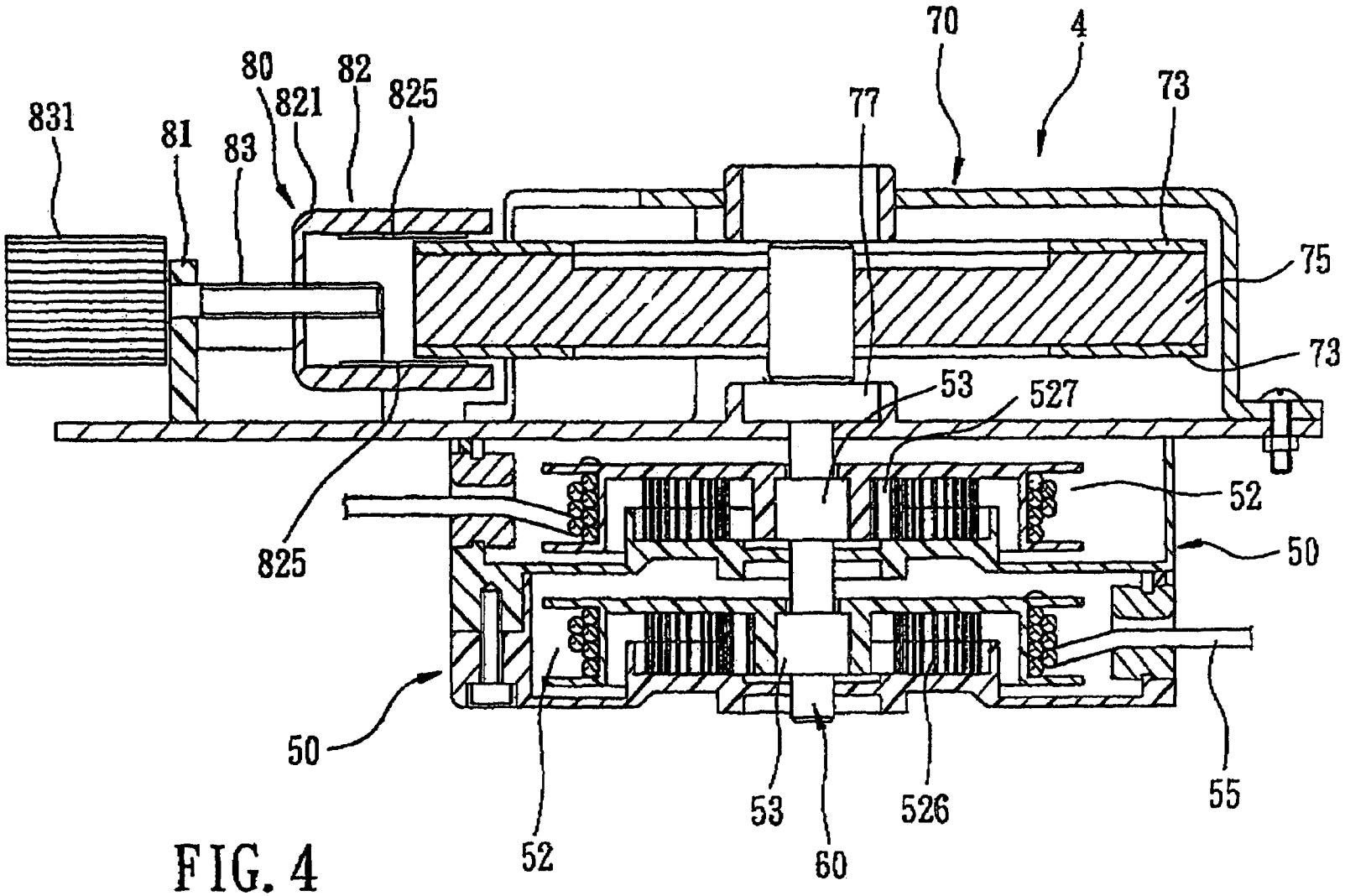
FIG. 4 is a fragmentary sectional view of the movable handle assembly of the first preferred embodiment.

Referring to FIGS. 3 and 4, with regard to the operation of the biasing units, because each of the upper and lower pulling devices 50, 50' is journalled to the rotary shaft 60 by means of the unidirectional bearing 53, when either of the handgrips 54 is pulled rearwardly, the corresponding pull cord 55 is unwound from the corresponding pulley 52 such that the corresponding pulley 52 rotates in a direction (A) (see FIG. 7) so as to rotate the rotary shaft 60 and the flywheel 75 synchronously with the corresponding pulley 52. Subsequently, upon release of the handgrip 54, the corresponding spring member 526 biases the corresponding pull cord 55 to wind around the corresponding pulley 52. At this time, the corresponding pulley 52 rotates in a direction that is opposite to the direction (A) (see FIG. 7) so that rotation of the corresponding pulley 52 cannot be transferred to the rotary shaft 60 and the flywheel 75.

Figure 5:
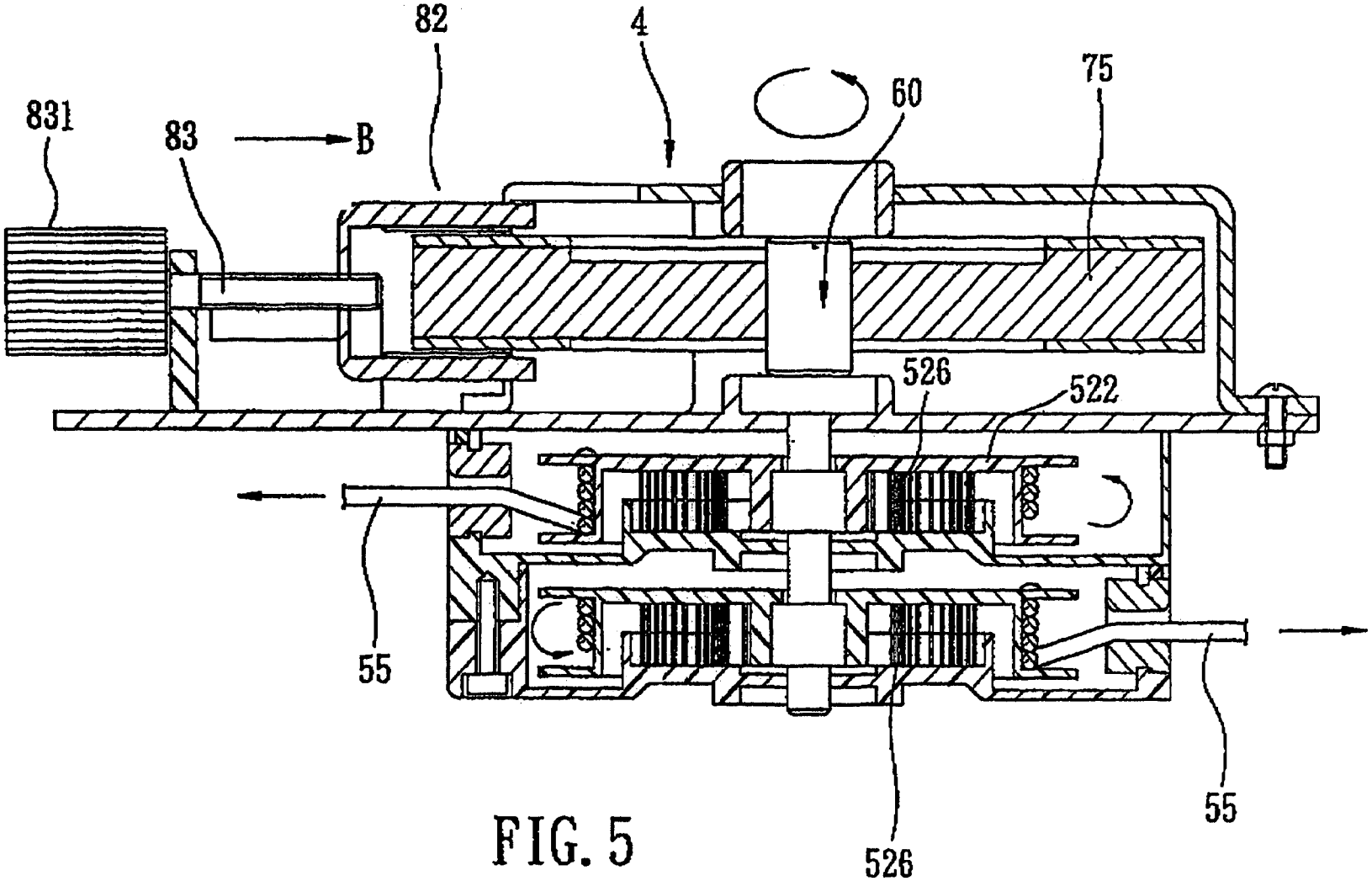
FIG. 5 is a view substantially similar to FIG. 4, illustrating how an adjustable magnetic resistance device of the movable handle assembly can be adjusted so as to move toward a flywheel assembly, and how the flywheel assembly and pulleys of the pulling devices of the movable handle assembly rotate when the pull cords of the pulling devices are pulled outwardly.

Referring to FIGS. 5 and 7, when the handgrips 54 are pulled, due to the magnetic force applied on the flywheel 75 by the magnet units 825, the spring members 526 and the magnetic resistance device 80 provide cooperatively a relatively great resistance to rearward movement of the handgrips 54 during exercise. Referring once again to FIG. 8, because the movable handle assembly 4 is disposed substantially higher than the fixed handles 30, when the user uses the pulling devices 50, 50', the handgrips 54 are pulled rearwardly and downwardly such that movement of the handgrips 54 can train not only the forearm muscles, but also the abdominal muscles.

Referring back to FIG. 5, when an increased load of exercise is desired, the hand knob 831 is rotated so as to move the magnet seat 82 toward the flywheel 75 in a direction (B) in order to obtain a greater magnetic force. When the magnet seat 82 is moved away from the flywheel 75, as shown in FIG. 4, the magnetic resistance is reduced.

Figure 9:
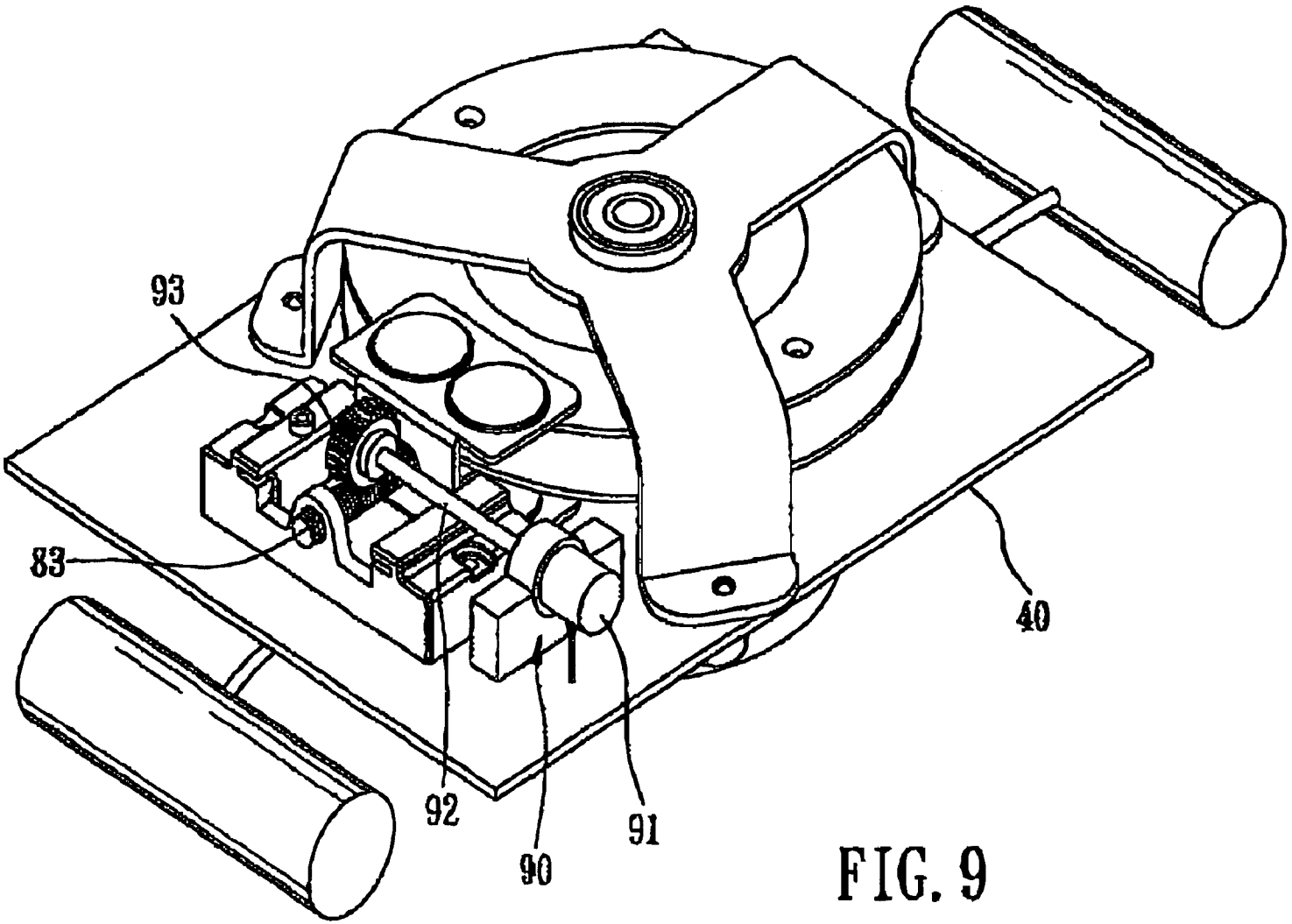
FIG. 9 is a perspective view of a movable handle assembly of the second preferred embodiment of a dual-function treading exerciser according to the present invention.
Figure 10:
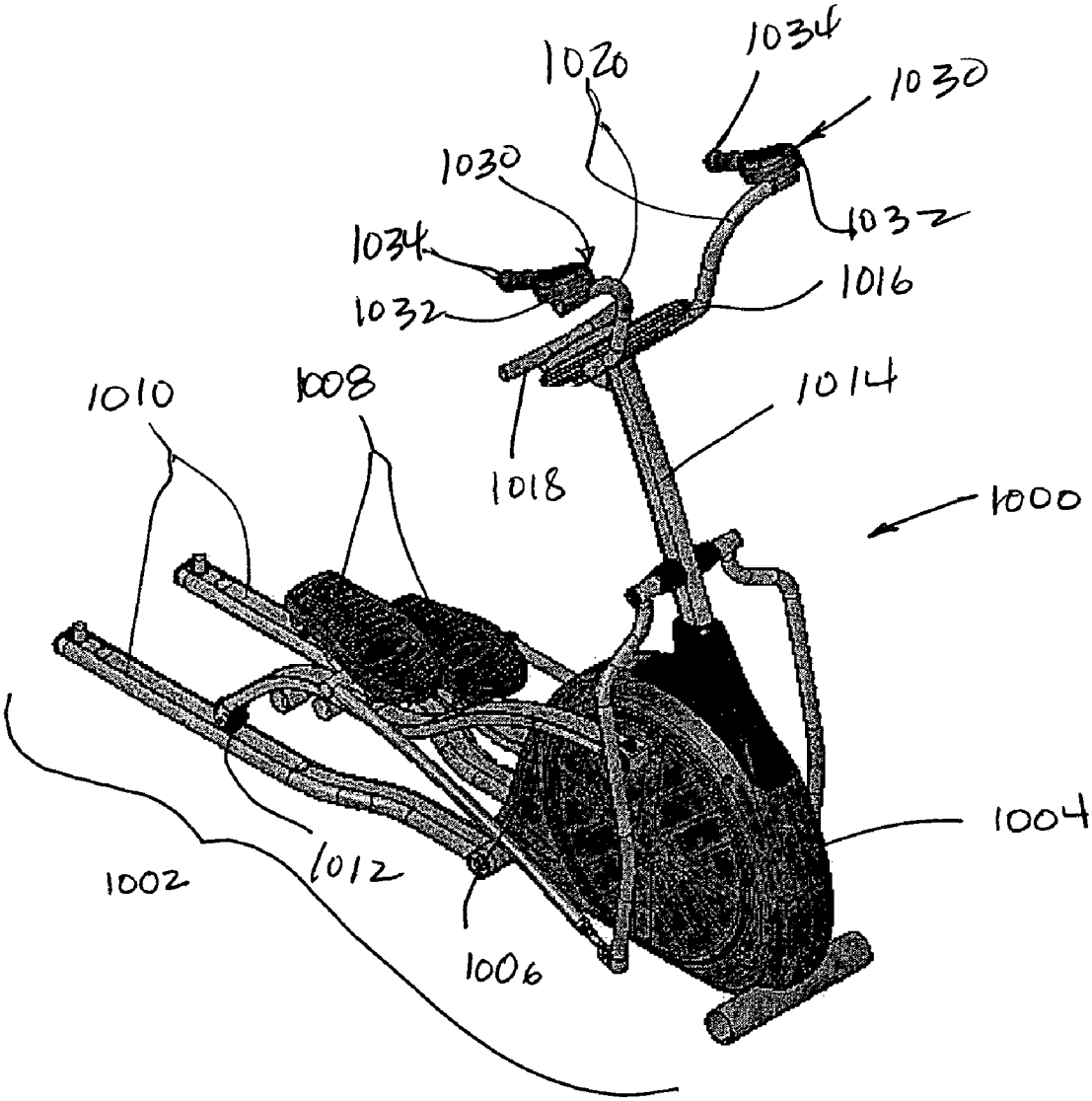
FIG. 10 is a perspective view of another dual-function exerciser in accordance with the present invention in the form of an elliptical machine with movable handle assemblies.
Figure 11:
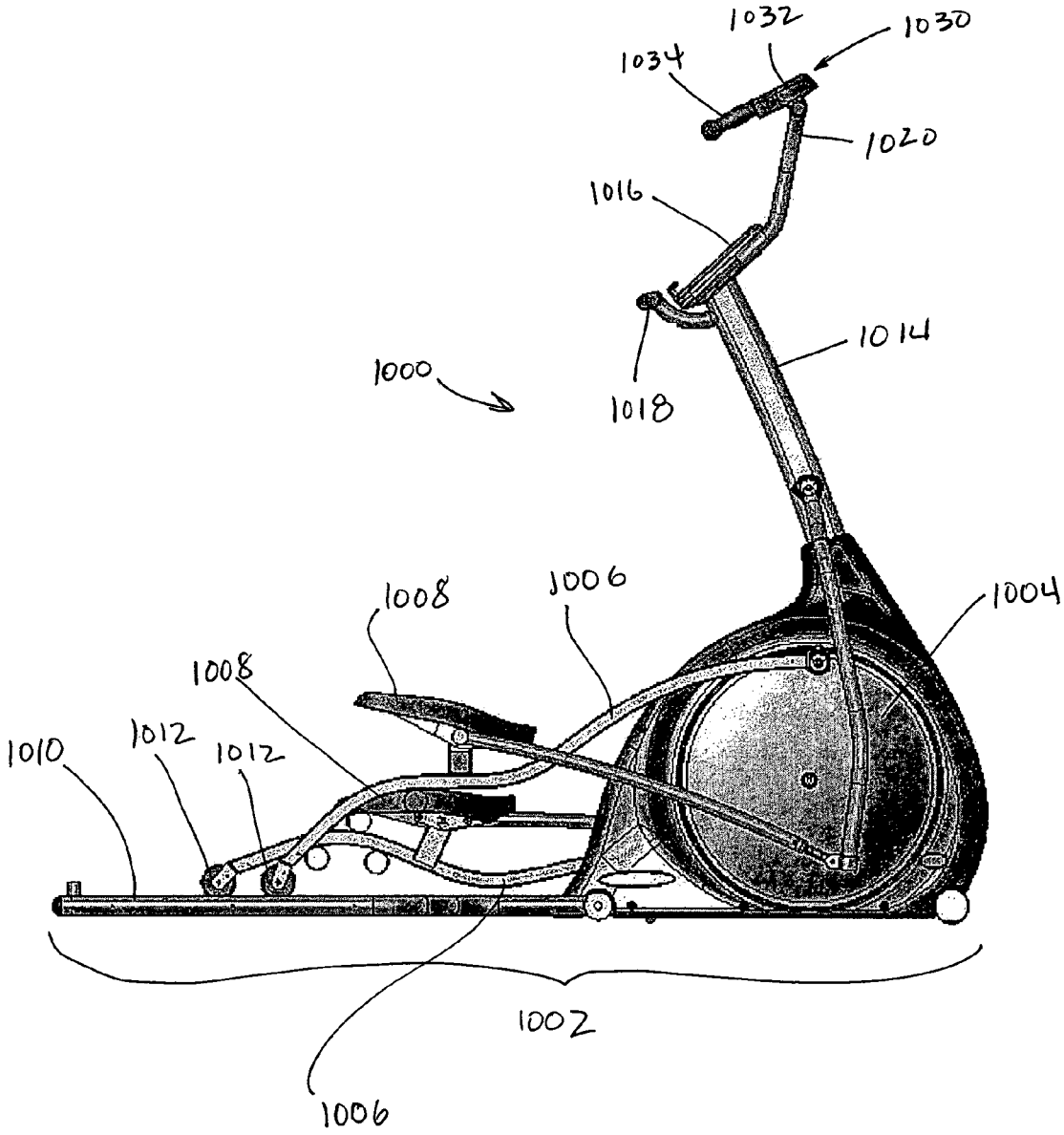
FIG. 11 is a side elevational view of the dual-function exerciser of FIG. 10.
Figure 12:
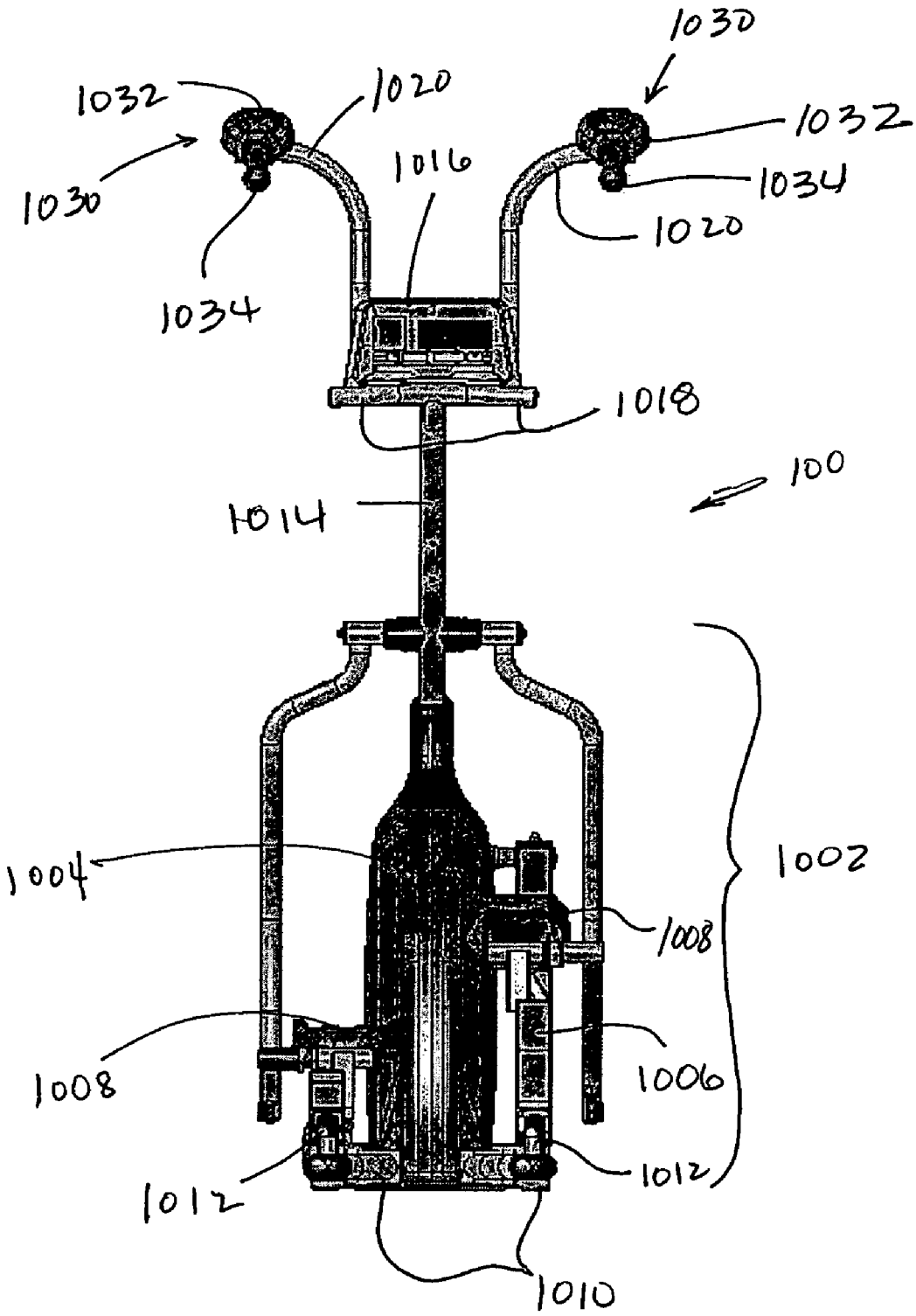
FIG. 12 is a rear elevational view of the dual-function exerciser of FIG. 10.
Figure 13:
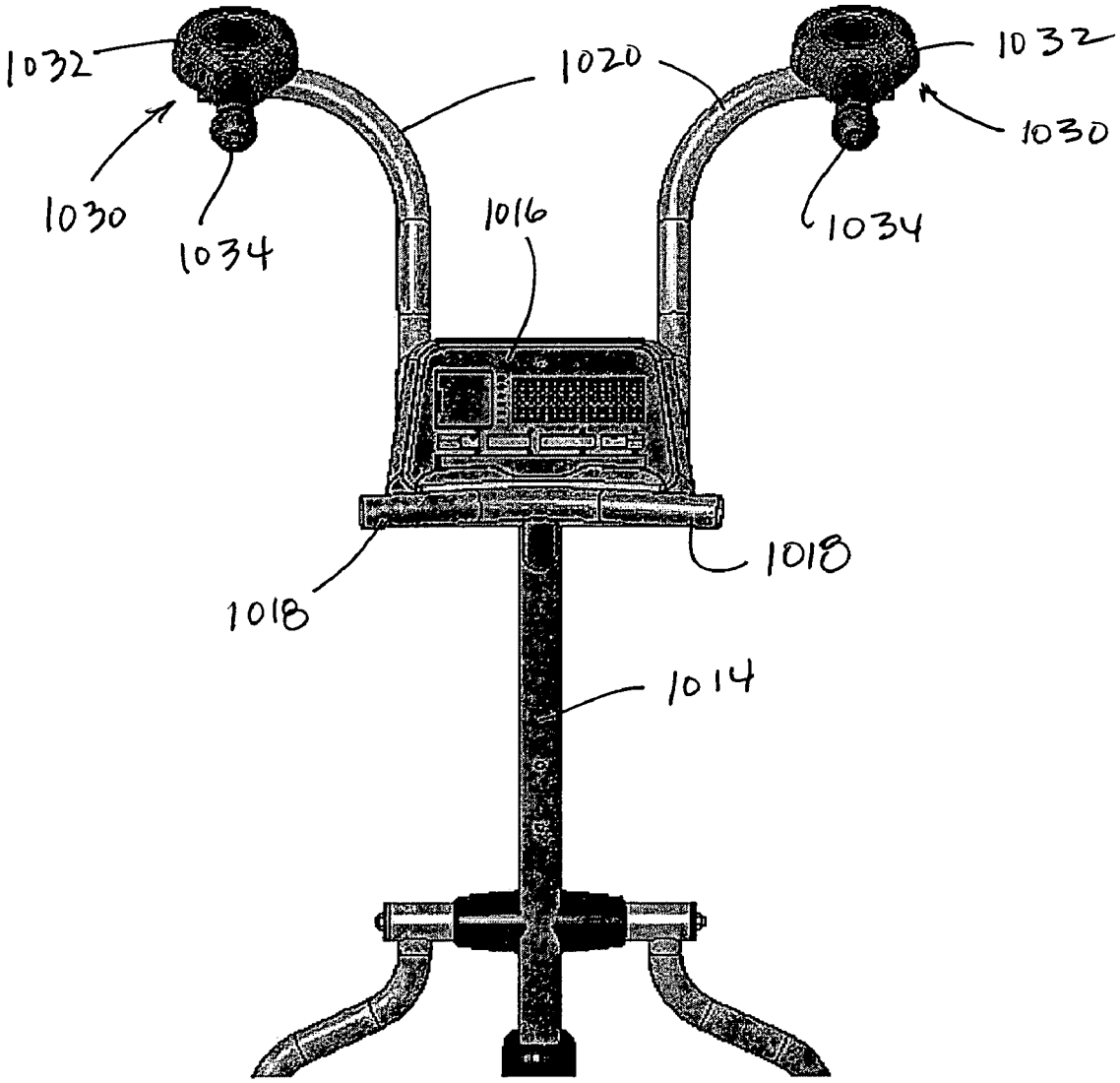
FIG. 13 is a partial rear elevational view of the dual-function exerciser of FIG. 10.
Figure 14:
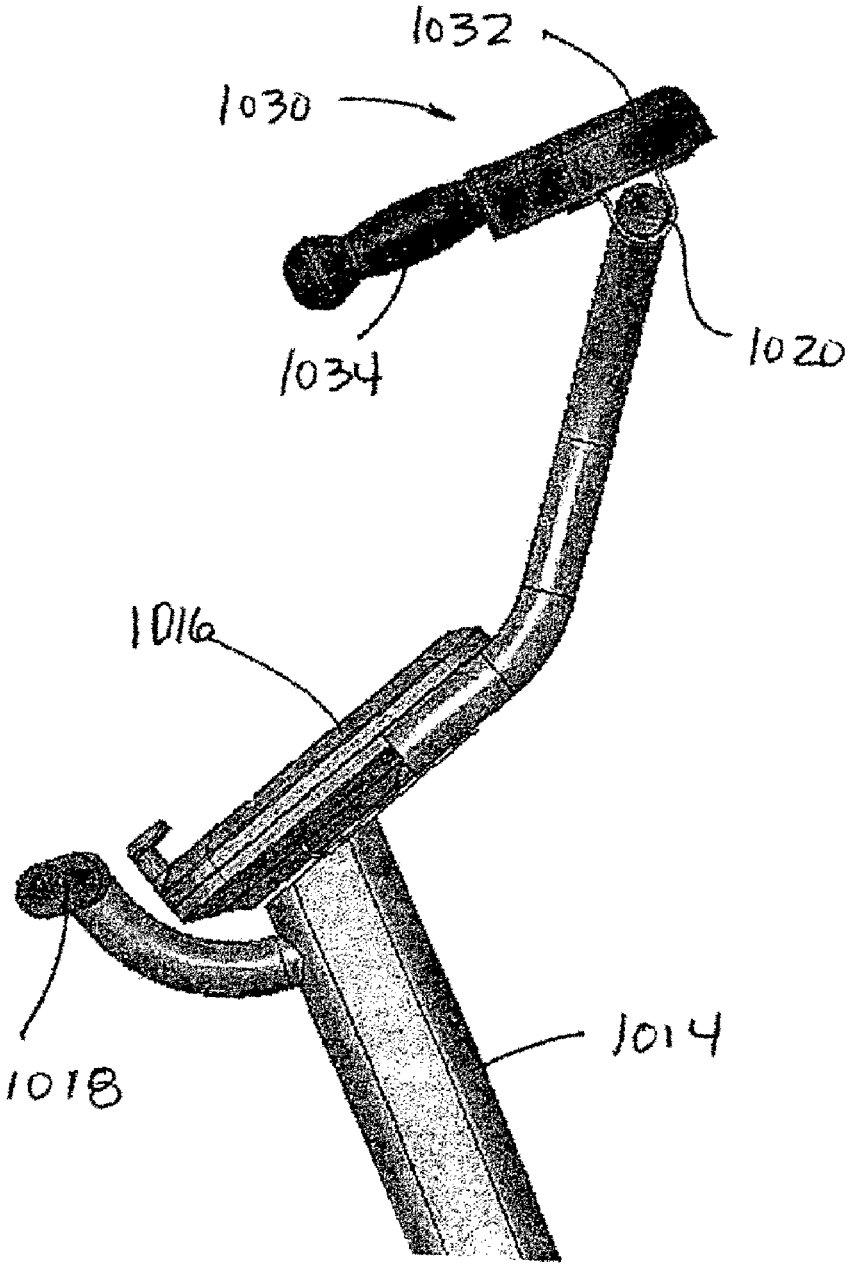
FIG. 14 is a partial side elevational view of the dual-function exerciser of FIG. 10.

Referring to FIG. 9, the adjustable magnetic resistance device 90 of the second preferred embodiment of the dual-function treading exerciser according to the present invention is shown to be substantially similar to the adjustable magnetic resistance device 80 (see FIG. 3) of the first preferred embodiment. However, in this embodiment, the magnetic resistance device 90 further includes a motor 91 and a gear 93. The motor is disposed on the support plate 40, and is provided with a motor shaft 92. The gear 93 is sleeved on the motor shaft 92, and engages the externally threaded portion of the threaded shaft 83 so as to transfer rotation of the motor shaft 92 to the threaded shaft 83.

For all embodiments of the present invention, the resistance on the cords can preferably be adjusted from 0 to 15 lbs in 0.5 lb increments. In addition, the independent moveable handle assemblies can be programmed to allow the user to simulate a variety of natural body movements similar to running, running on hills, ascending steps, and cross-country skiing. Exercises can also be programmed to optimize exercises for particular muscle groups such as the upper body, back, abdominals, triceps, biceps, and fat burning.

Further, the display can prompt the user to select exercises from a list including poling, double poling, chest fly, tricep pushdown, shoulder press, bicep curl, low row, and tricep extension. The device could also be programmed to sequence through a variety of these exercises for a well-rounded workout.

The dual-function treading exerciser of the present invention preferably has fixed handles 30 to support the user during a running exercise, but also has a movable handle assembly 4 that can effectively train arms, chest, back, abdominal, and leg muscles of the user and that can improve functioning of the user's cardiopulmonary system, thereby effecting exercise of the user's whole body.

The movable handle assembly 4, which includes the flywheel assembly 70 and the adjustable magnetic resistance device 80, enables the user to obtain a greater exercise effect. Furthermore, the presence of the upper and lower pulling devices 50, 50' in the movable handle assembly 4 enables the user's hands to follow the body movement in a comfortable and natural manner.

The movable handle assembly 4 is preferably disposed at a higher elevation than the fixed handles 30 so as to train not only the forearm muscles, but the stomach muscles as well.

In alternate embodiments, (not depicted) the movable hand assembly 4 is disposed at or below the elevation of the fixed handles 30. In these embodiments, the elevation from which the resistance is applied to an exerciser can be fixed at elevations at or above the user's shoulder height using pulleys or guides to re-direct the cord. The movable handle assemblies can be adjustable by shifting frame elements that re-position the movable hand assembly.

Similarly, lateral positions from which resistance is applied can be fixed or made adjustable. The various positions from which resistance is applied can be used to exercise muscle groups of different types, combinations, or strength levels of the user.

The user of the dual-function exerciser of the present invention has the option to move each handle independently from the other. The handles are preferably shoulder height and width apart and are moved together or separately back and downward with straight arms. The effect is to exercise the user's torso or "core" area, which can include the abdominals, obliques, lower back, lats, pectorals, and trapezius. Also, the shoulders and triceps are exercised. The combination of walking/running on a treadmill increases caloric expenditures while simultaneously toning and building torso and arm muscles.

By positioning a handle at shoulder height and moving it downward more torso muscles and muscle groups are exercised when compared to the use of prior art exercisers. With such larger muscles and muscle groups being exercised, caloric expenditures can increase up to 40% over a corresponding treadmill workout of similar duration. Further, independent movement of the handles permits more natural user movement, allows for a variety of different upper body exercises and enhances the user's ability to maintain balance.

Illustrated in FIGS. 10 through 14 is an alternate embodiment of a dual-function exerciser 1000 in accordance with the present invention. The exerciser 1000 includes a lower body exerciser 1002 in the form of an elliptical motion exercise device that includes a front fly wheel assembly 1004, a pair of rearwardly extending pedal arms 1006, a pair of foot pads 1008 mounted on the pedal arms 1006, and a pair of rails 1010 on which the rear ends 1012 of the pedal arms 1006 roll. There are a variety of elliptical motion exercise devices that can be used as the lower body exerciser 1002, but the embodiment illustrated is a typical design that can benefit from the use of the device 1000 as a dual-function unit.

Extending upward from the lower body exerciser 1002 is a mast 1014 that supports a display panel 1016, a pair of lower stationary handle bars 1018, and a pair of higher stationary handle bars 1020.

Mounted on the higher stationary handle bars 1020 is a pair of movable handle assemblies 1030 each of which includes a housing 1032 and a handle 1034. Each handle 1034 is connected to a cord and retracting mechanism as described above in reference to the other embodiments.

Operation of the elliptical embodiment of the dual-function exerciser 1000 is similar to that described above regarding the treading exerciser except that the user's legs move in an elliptical path. The upper body workout is the same as discussed above and includes as many options for independent arm movement and structural modifications as described above.

Other lower body exercise devices can also be included in the present invention.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

The invention claimed is:

1. A dual-function treading exerciser comprising:

a lower body exerciser and an upper body exerciser, said upper body exerciser including:

a frame joined to the lower body exerciser;

a movable handle assembly including a pair of pulling devices mounted on said frame, and a rotary shaft journalled substantially vertically on said frame, each of said pulling devices including, a pulley disposed on said frame, a pull cord wound on said pulley, a handgrip fastened to an end of said pull cord and movable rearwardly to unwind said pull cord from said pulley, and a biasing unit for biasing said pull cord to wind around said pulley when said cord is pulled rearwardly and is subsequently released;

a flywheel assembly mounted on said rotary shaft, said flywheel assembly including a flywheel and a pair of magnetically conductive rings disposed respectively and on opposite sides of said flywheel;

a unidirectional bearing disposed between said rotary shaft and each of said pulleys so as to rotate said rotary shaft synchronously with said pulleys only when said pulleys rotate in a direction in which said pull cords are unwound from said pulleys; and, a magnetic resistance device disposed adjacent to said flywheel assembly so as to provide resistance to rotation of said flywheel assembly.

2. The dual-function exerciser of claim 1, wherein said lower body exerciser comprises:

a treading platform; and a continuous tread extending around said platform.

3. The dual-function exerciser of claim 1, wherein said movable handle assembly is joined to a front portion of said frame.

4. The dual-function exerciser of claim 1, wherein said frame extends upwardly from a front portion of said dual-function exerciser.

5. The dual-function exerciser of claim 1, wherein said frame extends upwardly from a front portion of said dual-function exerciser, and said movable handle assembly is joined to an upper portion of said frame.

6. The dual-function exerciser of claim 1, and further comprising fixed handles, and wherein said movable handle assembly is disposed substantially higher than said fixed handles.

7. The dual-function exerciser of claim 1, wherein said biasing unit of each of said pulling devices includes a spring member biased to rotate in a predetermined direction.

8. The dual-function exerciser of claim 7, wherein said spring member is a spiral spring that is fastened to a housing at one end and to the respective one of said pulleys at the other end.

9. The dual-function treading exerciser of claim 1, wherein said magnetic resistance device includes:

a positioning seat fixed on said frame and having two spaced-apart parallel sliding rails; and a magnet seat including a U-shaped body, said body having two opposite side walls which are provided respectively with two aligned magnet units, between which said flywheel assembly is disposed, and a connecting wall which interconnects said side walls and which is formed with a threaded hole that engages a threaded shaft so as to move said U-shaped body toward and away from said flywheel when said threaded shaft is rotated relative to said positioning seat, thereby adjusting magnitude of the resistance.

10. The dual-function treading exerciser of claim 9, wherein said magnetic resistance device further includes:

a motor disposed on said frame and provided with a motor shaft; and a gear sleeved on said motor shaft and engaging an externally threaded portion of said threaded shaft so as to transfer rotation of said motor shaft to said threaded shaft.

11. A dual-function treading exerciser comprising:

a lower body exerciser and an upper body exerciser, said upper body exerciser including;

a frame joined to the lower body exerciser;

a movable handle assembly including a pair of pulling devices mounted on said frame, and a rotary shaft journalled substantially vertically on said frame, each of said pulling devices including, a chamber, a pulley disposed in said chamber, a pull cord wound on said pulley, a handgrip fastened to an end of said pull cord and movable rearwardly to unwind said pull cord from said pulley, and a biasing unit for biasing said pull cord to wind around said pulley when said cord is pulled rearwardly and is subsequently released;

a flywheel assembly mounted on said rotary shaft, said flywheel assembly including a flywheel, and a pair of magnetically conductive rings disposed respectively and on opposite sides of said flywheel;

a unidirectional bearing disposed between said rotary shaft and each of said pulleys so as to rotate said rotary shaft synchronously with said pulleys only when said pulleys rotate in a direction, in which said pull cords are unwound from said pulleys; and, a magnetic resistance device disposed adjacent to said flywheel assembly so as to provide resistance to rotation of said flywheel assembly.

12. The dual-function exerciser of claim 11, wherein said lower body exerciser comprises:

a treading platform; and a continuous tread extending around said platform.

13. The dual-function exerciser of claim 11, wherein said movable handle assembly is joined to a front portion of said frame.

14. The dual-function exerciser of claim 11, wherein said frame extends upwardly from a front portion of said dual-function exerciser.

15. The dual-function exerciser of claim 11, wherein said frame extends upwardly from a front portion of said dual-function exerciser, and said movable handle assembly is joined to an upper portion of said frame.

16. The dual-function exerciser of claim 11, and further comprising fixed handles, and wherein said movable handle assembly is disposed substantially higher than said fixed handles.

17. The dual-function exerciser of claim 11, wherein said biasing unit of each of said pulling devices includes a spring member biased to rotate in said chamber in a predetermined direction.

18. The dual-function exerciser of claim 17, wherein said spring member is a spiral spring that is fastened to a housing at one end and to the respective one of said pulleys at the other end.

19. The dual-function treading exerciser of claim 11, wherein said magnetic resistance device includes:

a positioning seat fixed on said frame and having two spaced-apart parallel sliding rails; and a magnet seat including a U-shaped body, said body having two opposite side walls which are provided respectively with two aligned magnet units, between which said flywheel assembly is disposed, and a connecting wall which interconnects said side walls and which is formed with a threaded hole that engages a threaded shaft so as to move said U-shaped body toward and away from said flywheel when said threaded shaft is rotated relative to said positioning seat, thereby adjusting magnitude of the resistance.

20. The dual-function treading exerciser of claim 19, wherein said magnetic resistance device further includes:

a motor disposed on said frame and provided with a motor shaft; and a gear sleeved on said motor shaft and engaging an externally threaded portion of said threaded shaft so as to transfer rotation of said motor shaft to said threaded shaft.

21. A dual-function treading exerciser comprising:

a lower body exerciser and an upper body exerciser, said upper body exerciser including;

a frame joined to the lower body exerciser;

a movable handle assembly including a pair of pulling devices mounted on said frame to operate independently of one another to enable a plurality of upper body exercises, and a rotary shaft journalled substantially vertically on said frame, each of said pulling devices including, a pulley disposed on said frame, a pull cord wound on said pulley, a handgrip fastened to an end of said pull cord and movable rearwardly to unwind said pull cord from said pulley, and a biasing unit for biasing said pull cord to wind around said pulley when said cord is pulled rearwardly and is subsequently released;

a flywheel assembly mounted on said rotary shaft, said flywheel assembly including a flywheel, and a pair of magnetically conductive rings disposed respectively and on opposite sides of said flywheel; and, a unidirectional bearing disposed between said rotary shaft and each of said pulleys so as to rotate said rotary shaft synchronously with said pulleys only when said pulleys rotate in a direction, in which said pull cords are unwound from said pulleys.

22. The dual-function exerciser of claim 21, wherein said lower body exerciser comprises:

a treading platform; and a continuous tread extending around said platform.

23. The dual-function exerciser of claim 21, wherein said movable handle assembly is joined to a front portion of said frame.

24. The dual-function exerciser of claim 21, wherein said frame extends upwardly from a front portion of said dual-function exerciser.

25. The dual-function exerciser of claim 21, wherein said frame extends upwardly from a front portion of said dual-function exerciser, and said movable handle assembly is joined to an upper portion of said frame.

26. The dual-function exerciser of claim 21, and further comprising fixed handles, and wherein said movable handle assembly is disposed substantially higher than said fixed handles.

27. The dual-function exerciser of claim 21, wherein said biasing unit of each of said pulling devices includes a spring member biased to rotate in a predetermined direction.

28. The dual-function exerciser of claim 27, wherein said spring member is a spiral spring that is fastened to a housing at one end and to the respective one of said pulleys at the other end.

29. The dual-function treading exerciser of claim 21, wherein said movable handle assembly further includes: magnetic resistance device disposed adjacent to said flywheel assembly so as to provide resistance to rotation of said flywheel assembly.

30. The dual-function treading exerciser of claim 29, wherein said magnetic resistance device includes:

a positioning seat fixed on said frame and having two spaced-apart parallel sliding rails; and a magnet seat including a U-shaped body, said body having two opposite side walls which are provided respectively with two aligned magnet units, between which said flywheel assembly is disposed, and a connecting wall which interconnects said side walls and which is formed with a threaded hole that engages a threaded shaft so as to move said U-shaped body toward and away from said flywheel when said threaded shaft is rotated relative to said positioning seat, thereby adjusting magnitude of the resistance.

31. The dual-function treading exerciser of claim 30, wherein said magnetic resistance device further includes:

a motor disposed on said frame and provided with a motor shaft; and a gear sleeved on said motor shaft and engaging an externally threaded portion of said threaded shaft so as to transfer rotation of said motor shaft to said threaded shaft.

* * * * *